US006030180A

United States Patent [19]

Clarey et al.

[11] Patent Number: 6,030,180

[45] Date of Patent: Feb. 29, 2000

[54] APPARATUS FOR GENERATING WATER CURRENTS IN SWIMMING POOLS OR THE LIKE

[76] Inventors: Michael Clarey, 112 Brackenbury Street, Warrandyte, Victoria 3113; Robert Joseph Lettini, 326 Dorset Road, Boronia, Victoria 3155, both of Australia

[21] Appl. No.: 08/793,455

[22] PCT Filed: Aug. 25, 1995

[86] PCT No.: PCT/AU95/00532

§ 371 Date: Mar. 28, 1997

§ 102(e) Date: Mar. 28, 1997

[87] PCT Pub. No.: WO96/06999

PCT Pub. Date: Mar. 7, 1996

[30] Foreign Application Priority Data

Aug. 26, 1994 [AU] Australia ..... PM7662
Apr. 21, 1995 [AU] Australia ..... PN2577

[51] Int. Cl.[7] ..... E04H 4/12

[52] U.S. Cl. ..... 417/18

[58] Field of Search ..... 417/18, 44.4, 423.9, 417/423.14; 4/541.1, 541.2, 541.3, 541.6, 492, 542, 509; 239/124

[56] References Cited

U.S. PATENT DOCUMENTS 3,977,027 8/1976 Speck ..... 4/172.16
4,665,572 5/1987 Davidson et al. ..... 4/492
4,853,987 8/1989 Jaworski ..... 4/542
5,347,664 9/1994 Hamza et al. ..... 4/509

FOREIGN PATENT DOCUMENTS

52361/73 2/1973 Australia ..... 52/86.1
1415627 11/1975 United Kingdom .

*Primary Examiner*—Timothy S. Thorpe
*Assistant Examiner*—Liem Nguyen
*Attorney, Agent, or Firm*—Watson Cole Grindle Watson, P.L.L.C.

[57] ABSTRACT

An apparatus for generating water currents in a swimming pool is provided in which an intake chamber, a discharge channel and a pump impeller are contained within a common housing. The discharge channel is defined within an open-ended discharge tube which extends longitudinally within the cylindrical housing. In use, the pump operates to suck water into the intake chamber around the tube through the front end of the housing. The water flows around the rear end of the discharge tube into the discharge chamber where it is expelled forcibly into the swimming pool through the discharge outlet at the open front end of the discharge tube. A pump stator member with radially extending guide vanes is provided in the discharge tube in front of the impeller to reduce swirling in the discharge channel. A safety guard may be provided over the inlet and the outlet at the front end of the housing.

33 Claims, 3 Drawing Sheets

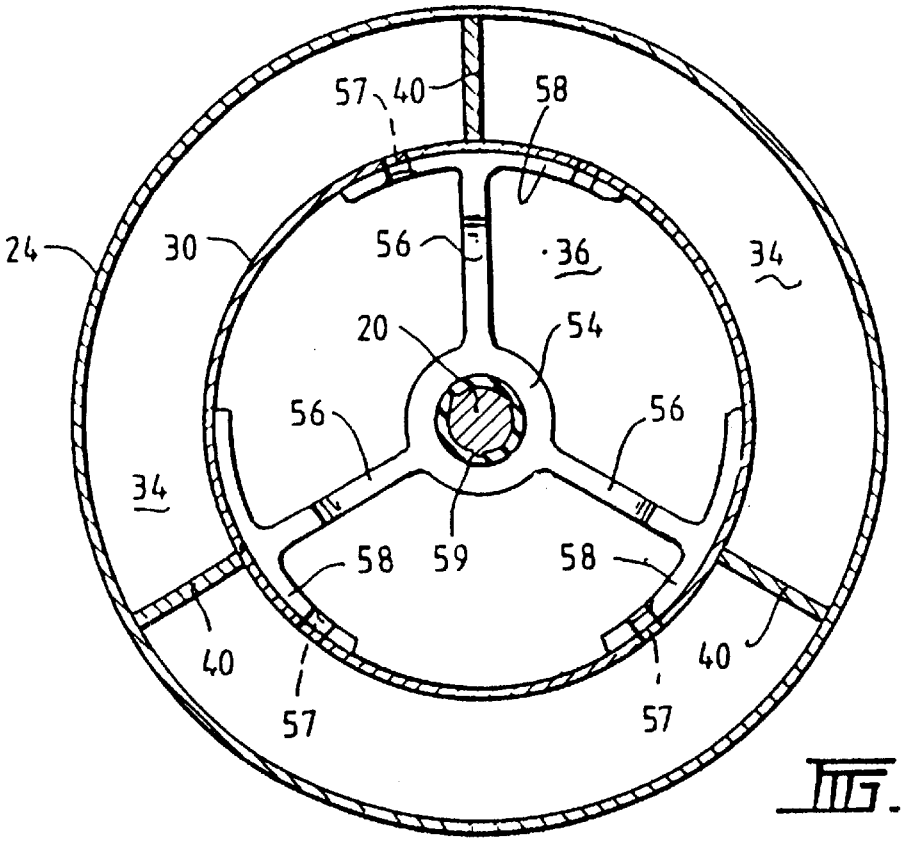
FIG. 4.
FIG. 5.
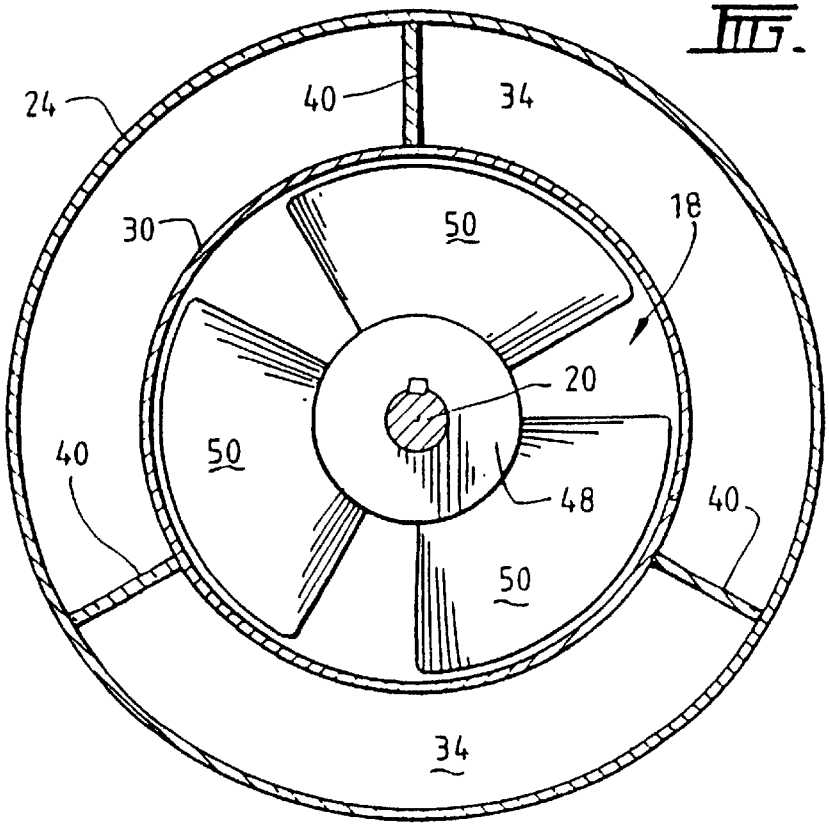

APPARATUS FOR GENERATING WATER CURRENTS IN SWIMMING POOLS OR THE LIKE

This invention relates to apparatus for generating a current in a swimming pool or other vessel containing a liquid such as water.

There have previously been proposed various types of apparatus for generating water currents in swimming pools whereby the water current acts as resistance to a swimmer so that swimming exercises can be carried out in a pool of quite short length.

Hitherto, most types of water current generating apparatus for swimming pools have consisted of a water inlet and intake pipe mounted in a wall of the swimming pool, a separate outlet pipe and water outlet mounted in another location of the swimming pool and pump or jet means for receiving water from the inlet pipe and arranged to forcibly eject the water through the outlet pipe and water outlet to create a water current in the swimming pool. This type of apparatus, however, suffers from the disadvantage that separate mountings for the intake and outlet pipes and for the pump are required to be made in the swimming pool.

It is therefore desirable to provide water current generating apparatus for swimming pools and the like in which one or more disadvantages of prior art apparatus are alleviated. It is also desirable to provide water current generating apparatus of a relatively simple construction which can be readily installed in the wall of a swimming pool or the like.

According to one aspect of the invention there is provided apparatus for generating a current in a swimming pool or other vessel containing a liquid, such as water, the apparatus comprising a liquid intake chamber for receiving liquid from the pool or other vessel, discharge means defining a discharge channel and having a discharge outlet, and pump means for receiving liquid from the intake chamber and discharging liquid into the pool or other vessel via the discharge channel and outlet, wherein the intake chamber and the discharge channel are contained within a common housing, the discharge channel being of tubular form and containing a pumping element of the pump means.

The discharge means preferably comprises a discharge tube or pipe extending longitudinally within the housing and arranged so that the space in the housing around the discharge tube forms the intake chamber. An open front end of the tube conveniently forms the discharge outlet and is at least partly surrounded by an inlet formed by an open front end of the housing leading to the intake chamber. The other, rear end of the tube is placed in communication with the intake chamber, preferably by terminating before a closed, rear end of the housing. Alternatively, one or more communication passages may be provided in a rear end portion of the discharge tube. The arrangement is preferably such that the liquid flows in one direction in the intake chamber and is directed by the closed end of the housing to flow in the opposite direction through the discharge channel containing the pumping element.

The pumping element of the pump means preferably comprises an impeller which may be rotatably driven by any convenient drive means, such as an electric drive motor. Preferably the drive means is connected to the impeller by a drive shaft which extends through a rear end wall of the housing remote from the inlet and outlet.

The discharge channel and/or the intake chamber may include guide means arranged to direct the water longitudinally along the discharge channel and/or the intake chamber.

Preferably, a safety guard or cover is provided for the inlet to the intake chamber to prevent part of a swimmer's body or clothing from being sucked into the apparatus when the pump means is operating. The discharge outlet preferably also has a safety guard to prevent objects being inserted into the discharge channel where the pumping impeller is located. A common safety guard in the form of a grid or grate may be provided which extends over the front ends of the housing and the discharge tube forming the inlet and outlet. Alternatively, the safety guards for the inlet and outlet may be formed in separate parts which may be adapted to fit together. In a particularly preferred embodiment, the safety guard for the inlet comprises a plurality of louvred cover members and a solid upper cover member.

As a further safety feature, the safety guard or at least one of the parts thereof may include a pressure sensitive switch operative to disable the electric drive motor when the safety guard is touched. The housing may also include at least one switch to detect the presence or absence of water in the housing and which is arranged to disable the motor when no water is detected by the switch.

A preferred embodiment of the present invention will now be described, by way of example only, with reference to the accompanying drawings in which:

FIG. 4 is a section on line 4—4 of FIG. 3; and

FIG. 5 is a section on line 5—5 of FIG. 5.

Figure 1:
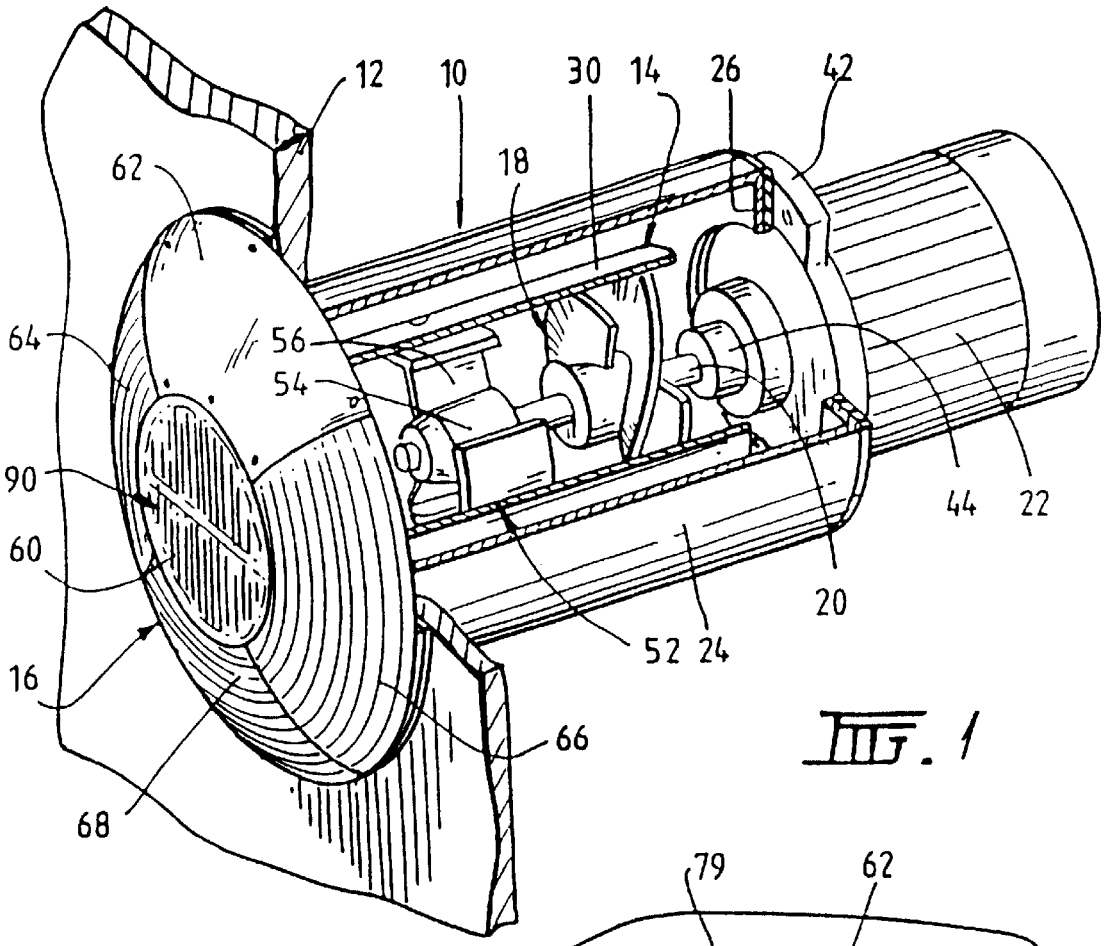
FIG. 1 is a fragmentary perspective view of water current generating apparatus in accordance with the invention.

The water current generating apparatus shown in the drawings comprises a housing 10 adapted to be mounted in a wall 12 of a swimming pool or like vessel, an open-ended discharge tube 14 contained within the housing 10, a safety guard 16 mounted over the front ends of the housing 10 and discharge tube 14, a pump impeller 18 disposed within the discharge tube 14 and mounted on a drive shaft 20, and an electric drive motor 22 for rotating the drive shaft 20.

Figure 2:
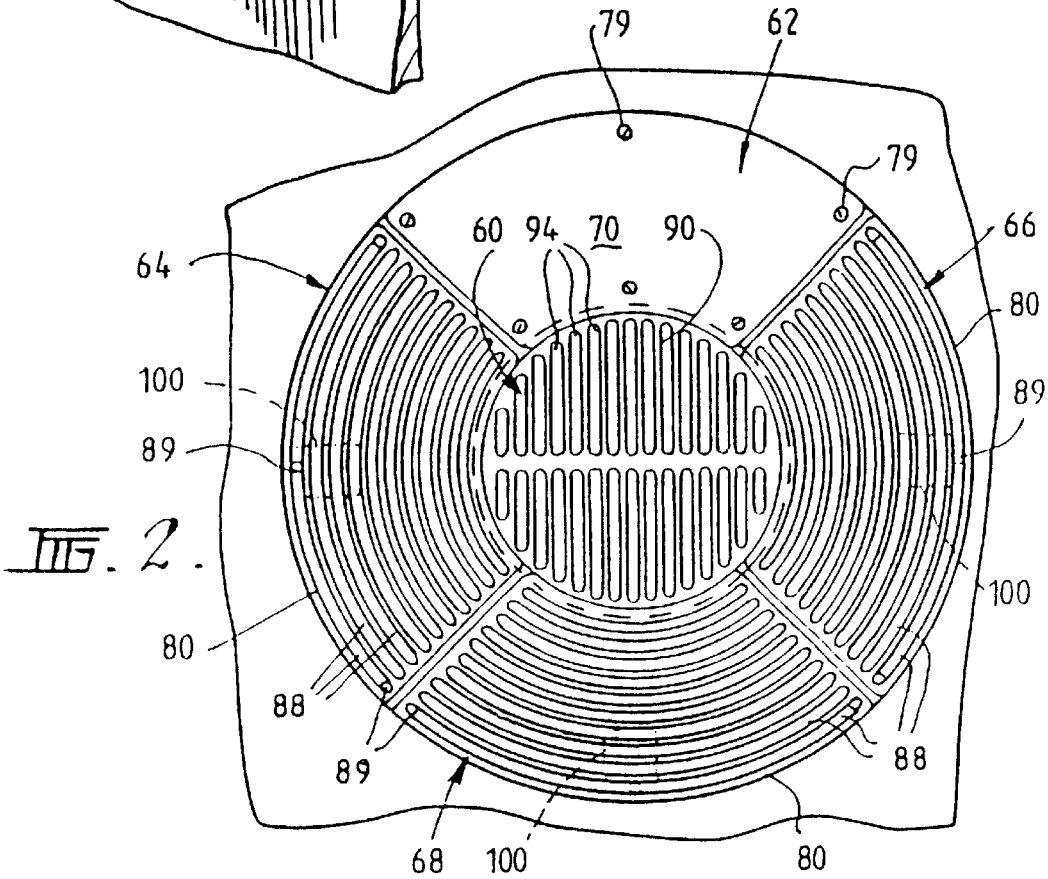
FIG. 2 is a front view of the apparatus of FIG. 1.
Figure 3:
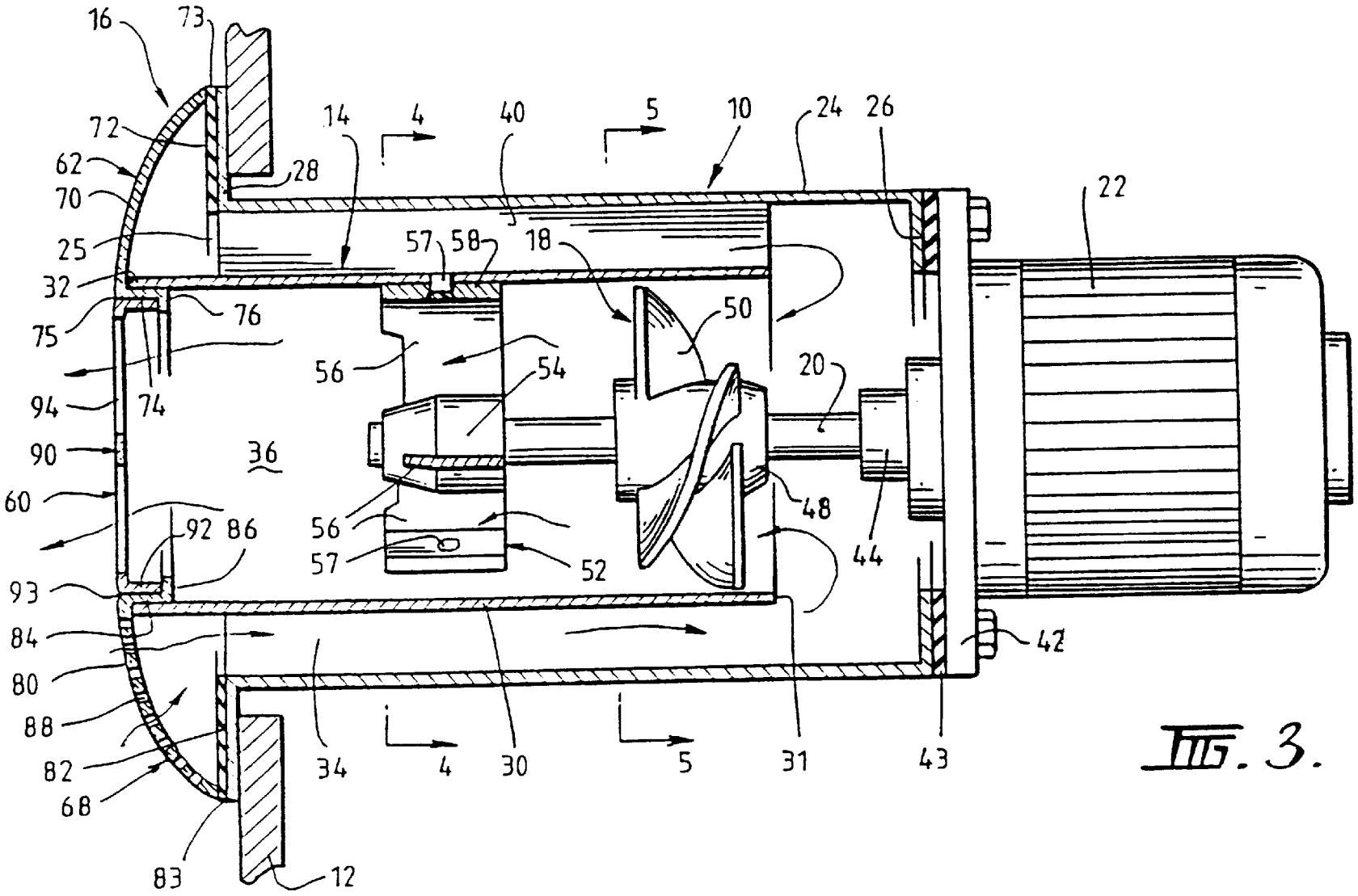
FIG. 3 is a side sectional view of the apparatus.

As shown in FIGS. 1 to 3, the housing 10 is generally cylindrical in form having a generally cylindrical side wall 24, an open front end 25 and a rear end wall 26. An annular flange 28 extends radially outwardly from the front end of the cylindrical side wall 24 to facilitate mounting of the housing 10 within a generally circular opening in the wall 12 of the swimming pool, for instance by a plurality of mounting bolts (not shown).

The discharge tube 14 comprises a pipe having a cylindrical wall 30 within and co-axial with the cylindrical wall 24 of the housing and having an open rear end 31 which terminates in front of the rear end wall 26 of the housing and an open front end 32 which terminates in front of the front end 25 of the housing. The annular space within the housing 10 surrounding the discharge tube 14 constitutes an intake chamber 34 for liquid and the space within the discharge tube constitutes a discharge channel 36 in communication with the intake chamber 34.

As shown more particularly in FIGS. 3 and 4 of the drawings, a number of circumferentially spaced, radially extending vanes 40 are provided between the cylindrical walls 24 and 30 of the housing 10 and discharge tube 14 respectively. FIG. 4 shows three vanes 40 circumferentially spaced around the discharge tube although the number and spacing of the vanes may vary as required. The vanes 40 assist in strengthening the housing assembly and also help to prevent swirling of water in the intake chamber 34 as it is sucked in by the pump impeller 18.

The drive shaft 20 of the pump impeller 18 extends axially through a mounting plate 42 for mounting the drive motor 22 to the rear end wall 26 and which closes the rear end of the housing 10. A sealing gasket 43 is provided between the rear end wall 26 and the mounting plate 42, and a sealing bush 44 is provided which allows the drive shaft 20 to rotate whilst sealing the rear end of the assembly.

As shown in FIGS. 1, 3 and 5, the pump impeller 18 has a central hub 48 and is adapted to be mounted on the drive shaft 20 so as to be rotatable with the drive shaft. The pump impeller shown in the drawings has three helically curved blades 50, although the number and shape of the impeller blades may be varied.

As shown in FIGS. 1, 3 and 4 a pump stator member 52 is provided in the discharge channel 36 within the discharge tube 14 in front of the impeller 18. Referring more particularly to FIGS. 3 and 4, the pump stator member 52 comprises a central, generally cylindrical portion 54 and a plurality of guide vanes 56 which extend radially outwardly from the cylindrical portion 54. As shown in FIG. 4, the pump stator member 52 has three circumferentially spaced guide vanes 56, although the number of vanes may also be varied. A peripheral mounting portion 58 extends circumferentially in both directions from the outer edge of each radially extending guide vane 56. The pump stator member 52 may be secured within the discharge tube 14 by bolts, screws or other attachment means extending through apertures 57 in the circumferentially extending peripheral portions 58 and through the cylindrical wall 30 of the tube 14. A cylindrical bush 59 of rubber of other elastomeric material is provided within an axially extending bore in the cylindrical portion 54 of the stator member 52 to rotatably receive the drive shaft 20.

Referring more specifically to FIGS. 2 and 3, the safety guard 16 is generally dish-shaped having a circular periphery. The safety cover comprises a circular inner guard member 60 surrounded by an outer safety guard formed from four curved outer cover sections, namely an upper cover section 62, two side cover sections 64 and 66 and a lower cover section 68. The upper cover section 62 has a solid curved front wall 70, an outer attachment flange 72 extending radially inwardly from the outer arcuate peripheral edge 73 of the curved front wall 70 and an inner attachment flange 74 extending rearwardly and axially from the inner edge 75 of the front wall 70 and having a extending lip 76 which extends radially inwardly from the rearmost end of the inner attachment flange 74.

The two side and the lower cover sections 64, 66 and 68 are of similar shape to the upper cover section 62 and each have a curved front wall 80 and outer and inner attachment flanges 82 and 84 of similar form to the outer and inner attachment flanges 72 and 74 of the upper cover section 62. Thus, the outer attachment flange 82 extends radially inwardly from the outer peripheral edge 83 of the front wall 80, and the inner attachment flange 84 extends rearwardly and axially from the inner edge of the front wall 80 and has a lip 86 which extends radially and inwardly from the rear end of the inner flange 84.

The side and lower outer cover sections 64, 66 and 68 differ from the upper cover section 62 in that their front walls 80 are louvred and have a plurality of arcuate openings 88 therein, in contrast to the solid front wall 70 of the upper cover section.

In assembly, the outer cover sections 62, 64, 66, 68 are attached to the annular flange 28 of the housing by means of screws 79, 89 or other attachment means passing through the front walls 70, 80 outer attachment flanges 72, 82 of the cover sections and the annular flange of the housing. When secured in this position, the inner attachment flanges 74, 84 of the cover sections 62, 64, 66, 68 fit into the open front end of the discharge tube 14.

The inner cover section 60 has a circular front wall 90 and an annular peripheral rim 92 which extends rearwardly and axially from the edge 93 of the front wall 90. The front wall 90 is also of louvred form having a plurality of openings 94 therein. As shown in FIG. 2, the openings 94, extend vertically, substantially parallel to each other, and the openings 94 are arranged in two sets, a first set above a horizontal center line of the front wall and a second set below the horizontal center line. The outer diameter of the peripheral rim 92 is such that the inner cover section 62 is adapted to be snugly received within the circular opening formed when the outer cover sections 62, 64, 66 and 68 have been attached to the housing with their inner attachment flanges 74, 84 extending alongside the inner surface of the open front end of the discharge tube 14. In the fully assembled construction, that the inner cover member 60 covers the front open end of the discharge tube 14. The outer cover sections 62, 64, 66 and 68, cover the annular space between the front ends of the housing 10 and the discharge tube 14 so as to prevent part of a swimmer's body being sucked into the apparatus when the pump is operating.

As shown in broken lines in FIG. 2, safety switches 100 in the form of pressure sensitive switches may be disposed behind the louvred front walls 80 of the side and lower cover sections 64, 66 and 68. The safety switches 100 are connected to the electrical supply (not shown) to the pump motor 22 and are arranged to disable the motor 22 when a swimmer presses against the front wall 80 of any one of the side and lower cover sections 64, 66 or 68. For this reason, the cover sections 64, 66 and 68 are conveniently made from plastics, fibre glass or other similar material so that the louvred front walls 80 do not deform to actuate the switches 100 under normal water pressure when the pump is operating and deform only when greater pressure is exerted thereon, for instance by a swimmer.

The housing 10 may also include at least one flow switch (not shown) to detect the presence or absence of water in the housing. Preferably, three flow switches are provided which are located in different regions of the intake chamber 34 behind the safety guard 16. The or each flow switch is connected to the electrical supply to the pump motor 22 and is arranged to disable the motor when no water is detected by the switch. The or each flow switch may comprise a pressure-sensitive switch which is activated by water pressure, and when a plurality of switches are provided in different locations in the housing, all of the switches must be activated to enable the pump motor 22 to start up or to run. The pump motor 22 may also include a flow light which indicates to the operator whether or not there is sufficient water in the pump housing 10 for the pump to run. It will thus be appreciated that the flow switch or switches prevent the pump from operating when there is no water in the swimming pool or when there is insufficient water in the pool.

In use, the drive motor 22 is operated to rotate the drive shaft 20 which causes the pump impeller 18 to rotate thereby drawing water from the swimming pool into the intake chamber 34 through the openings 88 in the louvred front walls 80 of the side and lower cover sections 64, 66 and 68. The water then flows around the rear end of the discharge tube 14 and into the discharge tube 14. The water is then pumped axially along the discharge channel 36 in the tube 14 and out through the openings 94 in the inner cover member 60 covering the front end 32 of the tube 14 and into the swimming pool to create a water current in the swimming pool.

As described above, the guide vanes 40 in the intake chamber 34 and the guide vanes 56 of the pump stator member 52 help to create a more linear flow of water through the intake chamber 34 and through the discharge channel 36. This helps to avoid turbulence, resulting in more efficient water current generation in the swimming pool.

The provision of a safety guard 16 with a solid upper cover section 62 and louvred side and lower sections 64, 66 and 68 ensures that water is sucked into the housing 10 only through the lower region of the front of the housing. This helps to prevent air being sucked in from adjacent the surface of the water in the swimming pool.

Furthermore, the provision of a single housing containing both the intake chamber and discharge channel and also the impeller of the pump results in a more compact pumping system which can be mounted in a single opening in the wall of the swimming pool.

It will be appreciated that various modifications and alterations may be made to the embodiment described above with reference to the drawings without departing from the scope and spirit of the invention. For instance, the shape of the housing for the assembly and the form of the pump impeller and stator members may vary for different applications. Also, the form of the safety guard may vary for different applications. It is also envisaged that the pumping apparatus of the present invention may be used for applications other than producing a water current in a swimming pool. For instance, it may be used in a slurry tank when a continuous movement or current in the slurry is desired.

We claim:

1. Apparatus for generating a current in a vessel containing a liquid, the apparatus comprising a housing having an open front end forming an inlet for receiving liquid from the vessel, an intake chamber within the vessel in communication with the inlet, a discharge tube within the housing defining a discharge channel and having an open front end forming a discharge outlet, pump means containing a pumping element for receiving liquid from the intake chamber and for expelling liquid into the vessel via the discharge channel and discharge outlet, and guide means outlet, and guide means arranged to direct liquid to flow longitudinally in the discharge channel substantially without swirling, wherein the inlet to the intake chamber and the discharge outlet from the discharge tube are disposed at the same end of the housing with the discharge outlet at least partly surrounded by the inlet formed by said open front end of the housing and wherein the discharge tube contains the pumping element of the pump means and the guide means, and wherein a safety guard is provided for the inlet to the intake chamber, the safety guard being formed from a plurality of grid or grate members having openings to allow liquid to pass through.

2. Apparatus according to claim 1, wherein the discharge tube is mounted within the housing such that the intake chamber is defined by a space within the housing around the discharge tube.

3. Apparatus according to claim 2 wherein the housing is of generally hollow cylindrical form and the discharge tube comprises a substantially cylindrical pipe extending longitudinally within the housing.

4. Apparatus according to claim 2 wherein when the pump means is operating liquid flows in a rearward direction in the intake chamber and is directed by a closed rear end of the housing to flow in the opposite direction through the discharge channel containing the pumping element.

5. Apparatus according to claim 4, wherein the rear ends of the housing and the discharge tube are arranged to provide communication between the intake chamber and the discharge channel, and the discharge tube has an open rear end which terminates in front of the closed rear end of the housing.

6. Apparatus for generating a current in a vessel containing a liquid, the apparatus comprising a housing, an intake chamber within the housing and having an inlet for receiving liquid from the vessel, a discharge tube within the housing defining a discharge channel and having an open front end forming a discharge outlet, pump means containing a pumping element for receiving liquid from the intake chamber and for expelling liquid into the vessel via the discharge channel and discharge outlet, and guide means arranged to direct liquid to flow longitudinal in the discharge channel substantially without swirling, wherein the inlet to the intake chamber and the discharge outlet from the discharge means are disposed at the same end of the housing with the discharge outlet at least partly surrounded by the inlet formed by an open front end of the housing wherein the discharge means contains the pumping element of the pump means and the guide means, wherein the intake chamber is defined by a space within the housing around the discharge tube, and wherein the discharge tube has an open rear end which terminates short of the closed rear end of the housing so that when the pump means is operating liquid flows in a rearward direction in the intake chamber and is directed by the closed rear end of the housing to flow in the opposite direction through the discharge channel containing the pumping element.

7. Apparatus according to claim 5 wherein a rear end portion of the discharge tube has at least one communication passage to provide communication between the intake chamber and the discharge channel.

8. Apparatus according to claim 1 wherein the guide means comprises a plurality of guide vanes provided in the tubular channel in front of the pumping element.

9. Apparatus according to claim 8 wherein the guide vanes extend substantially radially in the discharge channel.

10. Apparatus according to claim 8 wherein the guide vanes are provided on a pump stator member mounted in the tubular discharge means.

11. Apparatus according to claim 1, wherein the housing includes intake guide means provided in the intake chamber.

12. Apparatus according to claim 11 wherein the intake guide means comprises a plurality of guide vanes extending between a generally cylindrical wall of the housing and a generally cylindrical wall of the tubular discharge means.

13. Apparatus according to claim 1, wherein a safety guard is provided for the inlet to the intake chamber.

14. Apparatus according to claim 1, wherein a safety guard is provided for the discharge outlet.

15. Apparatus according to claim 13, wherein the outlet safety guard comprises at least one grid or grate member having openings therein to allow liquid to flow through the safety guard.

16. Apparatus according to claim 13 wherein the safety guard for the inlet to the intake chamber has a solid upper cover part which does not allow liquid to pass through.

17. Apparatus according to claim 13, wherein the safety guard for the inlet to the intake chamber is formed from a plurality of grid or grate members having openings to allow liquid to pass through.

18. Apparatus according to claim 13 wherein the or each grid or grate member is of louvred form.

19. Apparatus according to claim 1, wherein the pump means has a pumping element in the form of a rotatable impeller disposed within the discharge means and driven by pump drive means.

20. Apparatus according to claim 19 wherein the pump impeller is connected to the pump drive means by a rotatable shaft extending through a rear end wall of the housing.

21. Apparatus according to claim 19, wherein the pump drive means comprises an electric drive motor, a safety guard is provided for the inlet to the intake chamber and the safety guard includes at least one pressure sensitive switch operable to disable the drive motor when the safety guard is touched.

22. Apparatus according to claim 21 wherein the housing includes at least one switch to detect the presence or absence of water in the housing and which is arranged to disable the pump drive means when no water is detected by the switch.

23. Apparatus for generating a current in a vessel containing a liquid, the apparatus comprising a housing, an intake chamber within the housing and having an inlet for receiving liquid from the vessel, discharge means within the housing defining a discharge channel and having a discharge outlet, pump means containing a pumping element for receiving liquid from the intake chamber and for expelling liquid into the vessel via the discharge channel and discharge outlet, and guide means arranged to direct liquid flow longitudinally in the discharge channel substantially without swirling, wherein the inlet to the intake chamber and the discharge outlet from the discharge means are disposed at one same end of the housing, and the discharge means is of tubular form and contains the pumping element of the pump means and the guide means, and wherein the housing includes intake guide means provided in the intake chamber.

24. Apparatus according to claim 23, wherein the intake guide means comprises a plurality of guide vanes extending between a generally cylindrical wall of the housing and a generally cylindrical wall of the tubular discharge means.

25. Apparatus for generating a current in a vessel containing a liquid, the apparatus comprising a housing, an intake chamber within the housing and having an inlet for receiving liquid from the vessel, discharge means within the housing defining a discharge channel and having a discharge outlet, pump means containing a pumping element for receiving a liquid from the intake chamber and for expelling liquid into the vessel via the discharge channel and discharge outlet, and guide means arranged to direct liquid flow longitudinally in the discharge channel substantially without swirling, wherein the inlet to the intake chamber and the discharge outlet from the discharge means are disposed at the same end of the housing, and the discharge means is of tubular form and contains the pumping element of the pump means and the guide means, and wherein a safety guard is provided for the inlet and the discharge outlet.

26. Apparatus according to claim 25, wherein the safety guard comprises at least one grid or grate member having openings therein to allow liquid to flow through the safety guard.

27. Apparatus according to claim 25, wherein the safety guard has a solid upper cover part which does not allow liquid to pass through.

28. Apparatus according to claim 25, wherein the safety guard is formed from a plurality of grid or grate members having openings to allow liquid to pass through.

29. Apparatus according to claim 28, wherein the grid or grate member is of louvred form.

30. Apparatus according to claim 25, wherein the pump means has a pumping element in the form of a rotatable impeller disposed within the discharge means and driven by an electric drive motor and the safety guard includes at least one pressure sensitive switch operable to disable the drive motor when the safety guard is touched.

31. Apparatus for generating a current in a vessel containing a liquid, the apparatus comprising a housing having an open front end forming an inlet for receiving liquid from the vessel, an intake chamber within the vessel in communication with the inlet, a discharge tube within the housing defining a discharge channel and having an open front end forming a discharge outlet, pump means containing a pumping element for receiving liquid from the intake chamber and for expelling liquid into the vessel via the discharge channel and discharge outlet, and guide means arranged to direct liquid to flow longitudinally in the discharge channel substantially without swirling, wherein the inlet to the intake chamber and the discharge outlet from the discharge tube are disposed at the same end of the housing with the discharge outlet at least partly surrounded by the inlet formed by said open front end of the housing and wherein the discharge tube contains the pumping element of the pump means and the guide means, and wherein a safety guard is provided for the inlet to the intake chamber, the safety guard having a solid upper cover part which does not allow liquid to pass through.

32. Apparatus for generating a current in a vessel containing a liquid, the apparatus comprising a housing having an open front end forming an inlet for receiving liquid from the vessel, an intake chamber within the vessel in communication with the inlet, a discharge tube within the housing defining a discharge channel and having an open front end forming a discharge outlet, pump means containing a pumping element for receiving liquid from the intake chamber and for expelling liquid into the vessel via the discharge channel and discharge outlet, and guide means arranged to direct liquid to flow longitudinally in the discharge channel substantially without swirling, wherein the inlet to the intake chamber and the discharge outlet from the discharge tube are disposed at the same end of the housing with the discharge outlet at least partly surrounded by the inlet formed by said open front end of the housing and wherein the discharge tube contains the pumping element of the pump means and the guide means, and wherein the pump means has a pumping element in the form of a rotatable impeller disposed within the discharge tube and driven by pump drive means, the pump drive means comprising an electric drive motor, a safety guard provided for the inlet to the intake chamber, and the safety guard including at least one pressure sensitive switch operable to disable the drive motor when the safety guard is touched.

33. Apparatus according to claim 1, wherein each of the grid or grate members is of louvered form.

* * * * *